US006099488A

United States Patent [19]

Hung

[11] Patent Number: 6,099,488

[45] Date of Patent: Aug. 8, 2000

[54] MASSAGE APPARATUS FOR COLONIC TRANSIT

[76] Inventor: Chuang-Ti Hung, 629 N. 13th Ave., Upland, Calif. 91788

[21] Appl. No.: 08/851,245

[22] Filed: May 5, 1997

[51] Int. Cl.[7] ..... A61H 15/00

[52] U.S. Cl. ..... 601/119; 601/129; 601/135

[58] Field of Search ..... 601/46, 69–71, 601/78–80, 85, 97, 118–121, 123, 125, 129, 131, 134–138; 128/849, 853

[56] References Cited

U.S. PATENT DOCUMENTS

| | | | |
|---|---|---|---|
| 693,064 | 2/1902 | Proben et al. . | |
| 1,026,480 | 5/1912 | Ward | 601/135 |
| 4,266,536 | 5/1981 | Casares | 601/119 |
| 5,218,955 | 6/1993 | Gueret . | |

FOREIGN PATENT DOCUMENTS

| | | | |
|---|---|---|---|
| 1162945 | 9/1958 | France | 601/80 |
| 188151 | 3/1937 | Switzerland | 601/134 |

*Primary Examiner*—Danton D DeMille
*Attorney, Agent, or Firm*—Boniard I. Brown

[57] ABSTRACT

Apparatus for effecting colonic transit having a pad, defining a guide groove to overly the abdomen of a person, a roller, movable along the guide groove to apply pressure progressively along the groove to effect movement of colonic contents along the colon. The guide groove may be defined in a pad or may be defined by ridges extending outwardly of a member such as a pad. The roller may comprise a handle and a roller wheel, with the wheel preferably swivelly mounted relative to the handle.

9 Claims, 2 Drawing Sheets

MASSAGE APPARATUS FOR COLONIC TRANSIT

BACKGROUND AND PRIOR ART

Constipation and fecal impaction have long been well-known problems, particularly with respect to persons who are hospitalized, in care homes, bedridden, elderly or who have particular ailments.

Attending persons, including medical personnel, householders and others, are generally reluctant or unwilling to manually manipulate the abdomen of a person or patient in the effort to effect movement of waste through the colon. Physicians or other persons cannot at all readily detect colon impaction so as to enable treatment at particular locations.

Adequate means or equipment have not been provided to address the problem. Massage rollers have been provided for other purposes, such as the massage devices or rollers of U.S. Pat. No. 693,064 to Proven and Fischer, and U.S. Pat. No. 5,218,955 to Gueret, however such rollers have no means for guidance for accurate following of a colon configuration and depend upon user's idea of where pressure should be applied, and many persons are often unwilling to engage in efforts at colonic transit.

There has long existed a need for means to effect colonic transit by the progressive urging of material along the colon of a person to effect relief of constipation or fecal impaction.

SUMMARY OF THE INVENTION

Apparatus is provided for the effecting of colonic transit, and comprises means, typically pad means, defining a guide groove adapted to overly the colon of a person, and means, typically roller means, movable along the groove while applying pressure progressively along the groove to effect movement of contents along the colon.

The apparatus and method of the invention may be utilized with a variety of persons having constipation or fecal impaction problems, particularly persons who are bedridden, hospitalized, or in care homes, or elderly, such persons being among those likely to be affected with such problems.

DESCRIPTION OF A PREFERRED EMBODIMENT OF THE INVENTION

Figure 1:
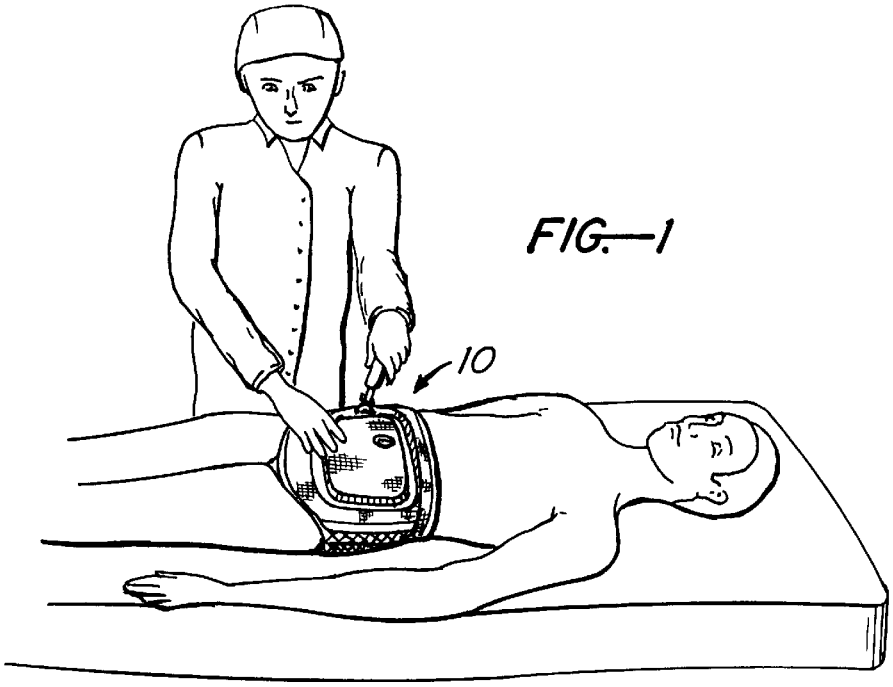
FIG. 1 is a perspective view of the apparatus of the invention in relation to an operator and a person being treated.

Referring to the drawings, a preferred embodiment of the apparatus 10 of the invention is shown as comprising a pad 12, preferably formed of appropriate plastic foam material and having a cover, typically formed of Nylon or the like, and defining a channel or groove 14. An alternative form 15 of the groove defines the channel or groove by ridges 16 extending outwardly from the pad, as shown. The groove or channel is sized and configurated to overlie the colon of the person. The groove is preferably coated with Teflon or the like to minimize friction between the walls of the groove and a roller. Mounting straps 18, 20 extend from opposite side edges of the pad 12 and are attached to the pad and its cover, as by stitching or being integral with the pad cover. The straps are adapted to extend about the body of a person and have respective end portions 22, 24 with cooperating Velcro hook and loop fastener means for securement about the person. These strap portions are preferably fabricated of a stretchable flexible material, such as woven plastic material used in stretchable bandages.

Figure 2:
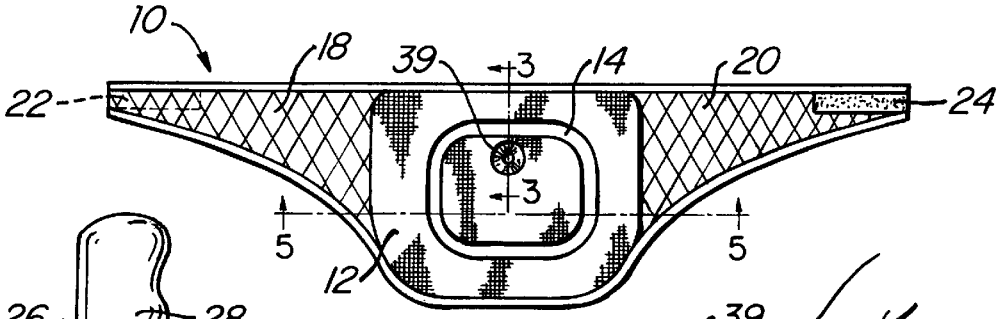
FIG. 2 is a plan view of a pad assembly according to the invention.
Figure 4:
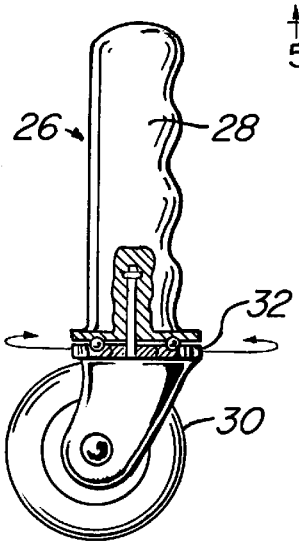
FIG. 4 is an elevational view of a manual roller device utilized with the invention.
Figure 8:
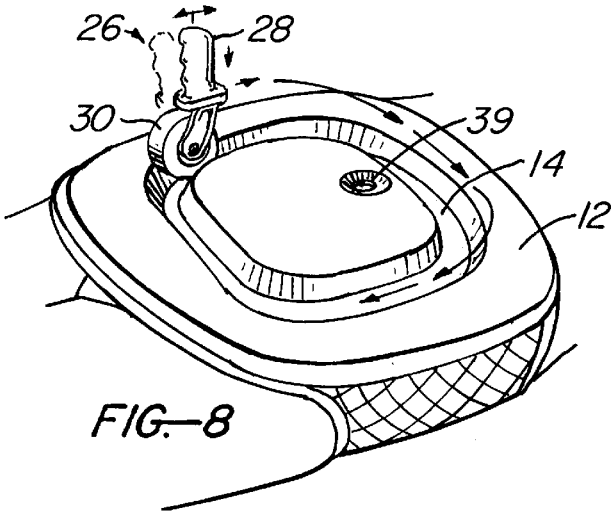
FIG. 8 is a perspective view of the pad assembly of FIG. 2 in operative relation with the roller of FIG. 4.

A massage roller 26 (FIG. 4) having a handle 28 for manual grasping, and a roller wheel 30 adapted to roll in groove 14. The roller is preferably swiveled relative to the handle, as indicated at 32 to enable it to pivot relative to the handle, thus to facilitate accurate, smooth movement of the roller in the groove. As shown in FIGS. 2 and 8, the groove preferably has rounded corner portions to facilitate the turning and ready following of the roller in the groove according to the configuration of a colon of the person.

Figure 9:
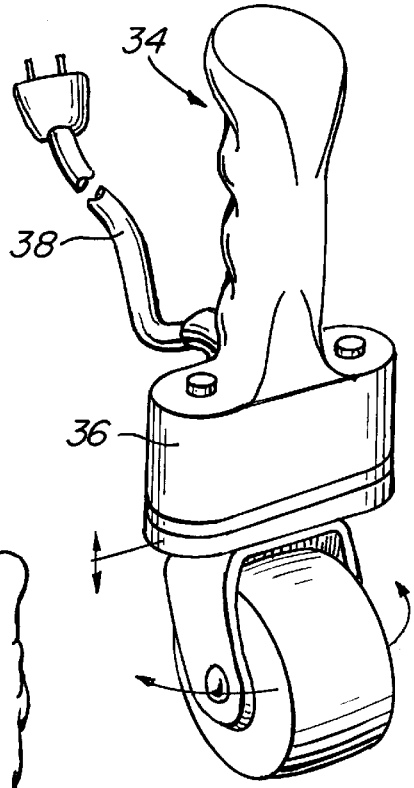
FIG. 9 is a perspective view of a roller device which incorporates a vibrator for use with the present invention.

FIG. 9 shows a preferred form of massage roller 34 which includes a vibrator device 36 powered by connection by a line 38 to a conventional source of electrical power, or which may embody a battery (not shown) to provide power. Like the massage roller of FIG. 4, the device of FIG. 9 in swivelly mounted (not shown) relative to the handle. The vibrator provides additional and relatively high frequency mechanical action for improved action in urging colonic contents along a colon to facilitate colonic transit.

In practice, the condition of a person or patient, as to a constipated or fecal impaction condition, may typically be ascertained by determining the frequency of colon constriction, which is normally about three times per minute. If this rate of constriction is slowed, constipation or impaction may be indicated.

Figure 6:
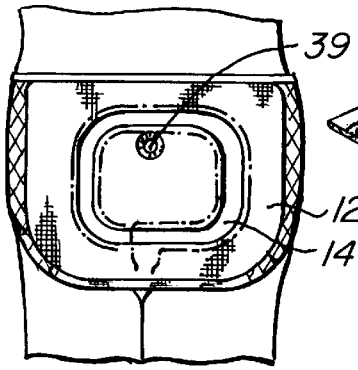
FIG. 6 a plan view of a pad assembly of the invention disposed on a person.
Figure 7:
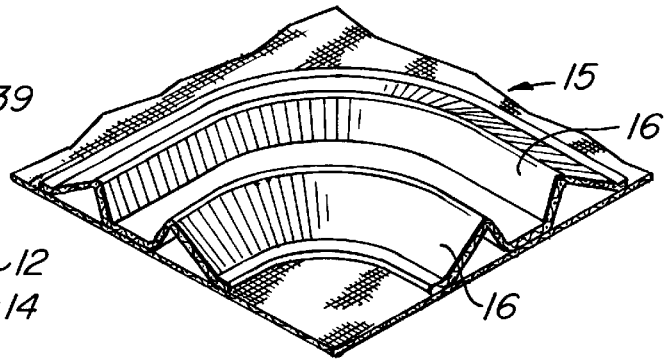
FIG. 7 is a partial perspective view of a modified form of pad according to the invention.

In utilizing the apparatus and method according to the invention, the roller is positioned in the groove 14, preferably in a position which overlies the lower portion of the ascending colon (FIG. 8). The roller is urged along the groove while the operator exerts pressure along the abdomen of the person. The roller is first urged upwardly along the ascending colon, then across the upper portion of the groove and along the transverse colon, then downwardly along the groove above the descending colon. As shown in FIG. 6, with application of pressure, roller wheel 30 is urged downwardly to deform the lower wall of the pad into the person's abdomen to exert pressure on the colon 35. In practice, about ten to twenty passes of a roller along the groove requires about ten minutes to produce desired results.

Figure 3:
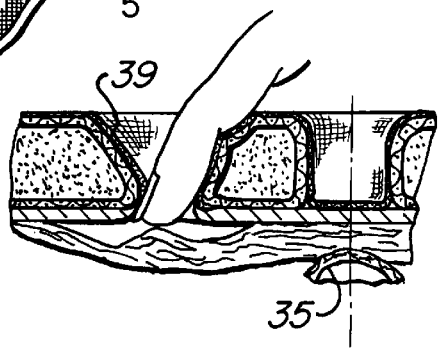
FIG. 3 is a sectional view taken at line 3—3 in FIG. 2, showing a finger in an opening to facilitate location and positioning of the pad assembly of FIG. 2.
Figure 5:
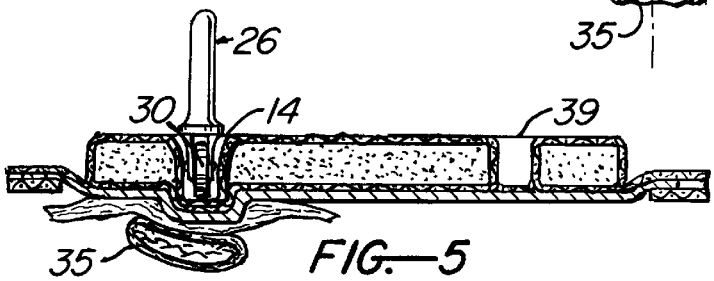
FIG. 5 is a sectional view taken at line 5—5 in FIG. 2, and showing a finger in an opening in the pad.

Referring to FIG. 3, an opening for passage 39 is preferably provided in the pad to enable the insertion of a finger of a person to locate the navel (belly button) of the person, thus to orient and position the pad and the groove relative to the colon of the person. It is often difficult to locate the navel of the person and to accurately position the pad.

Figure 10:
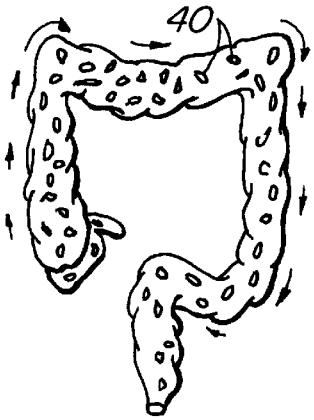
FIGS. 10 and 11 are plan views of a colon with radiopaque pellets therein to indicate relative effectiveness of colonic transit treatment.
Figure 11:
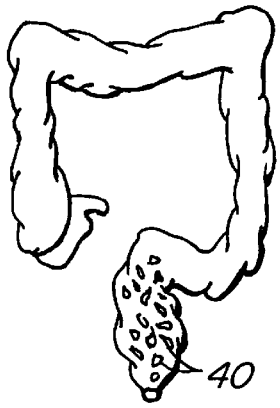

Referring to FIGS. 10 and 11, conventional radiolucent or radiopaque capsules 40 may be utilized in the colon of a person to indicate the effectiveness of colonic transit treatment. The capsules are ingested by the person, and their later disposition in the colon indicates the effectiveness of colonic transit treatment. If, after treatment the capsules are spaced along the colon (FIG. 10) poor results are indicated, whereas if the capsules 40 are gathered in the rectal area (FIG. 11) good results are indicated.

Thus there has been shown and described a novel massage apparatus for colonic transit which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. Apparatus for effecting colonic transit, comprising:

a pad defining a guidance path adapted to overlie the abdomen of a person, guidance surfaces disposed at curved portions of said guidance path and disposed at substantial angles relative to said path, and a pressure applicator movable along said guidance path and constrained by said guidance surfaces to apply pressure progressively along the path to effect movement of colonic contents along the colon.

2. Apparatus according to claim 1 wherein the guidance path includes ridge means extending outwardly from the pad.

3. Apparatus according to claim 2 and further including means for attaching said pad on the person.

4. Apparatus according to claim 1 and further including means for attaching said pad on the person.

5. Apparatus for effecting colonic transit according to claim 1, wherein said guidance path includes a groove defined to overlie the abdomen of the person.

6. Apparatus according to claim 3, wherein said means for attaching on the person comprises retaining straps extending from the pad and about the person, said retaining straps having outer end portions adapted for attachment together.

7. Apparatus according to claim 1 wherein said pressure applicator movable along the guidance path comprises roller means.

8. Apparatus according to claim 7 wherein said roller means comprises a handle for manual grasping and a roller wheel connected with the handle.

9. Apparatus according to claim 8 wherein said roller wheel is swivelly connected with said handle.

* * * * *